United States Patent [19]

Rusnock

[11] Patent Number: 4,634,007

[45] Date of Patent: Jan. 6, 1987

[54] CARTON BLANK WITH PERFORATED TEAR LINE

[75] Inventor: Kevin R. Rusnock, Boulder, Colo.

[73] Assignee: Adolph Coors Company, Golden, Colo.

[21] Appl. No.: 803,632

[22] Filed: Dec. 2, 1985

[51] Int. Cl.[4] ..... B65D 5/54

[52] U.S. Cl. ..... 206/620; 206/634; 229/DIG. 5

[58] Field of Search ..... 229/DIG. 5; 206/604, 206/620–630, 634

[56] References Cited

U.S. PATENT DOCUMENTS

| | | | |
|---|---|---|---|
| 2,967,010 | 1/1961 | Cuffey, Jr. et al. | 229/DIG. 5 |
| 3,253,764 | 5/1966 | Goetschius et al. | 206/620 |
| 3,310,222 | 3/1967 | Buttery | 206/624 |
| 3,501,082 | 3/1970 | Lock | 206/620 |
| 3,863,834 | 2/1975 | Sanford | 229/DIG. 5 |
| 4,511,042 | 4/1985 | Wischusen, III | 206/620 |

FOREIGN PATENT DOCUMENTS

| | | | |
|---|---|---|---|
| 1042456 | 10/1958 | Fed. Rep. of Germany | 206/620 |
| 2917795 | 8/1980 | German Democratic Rep. | 206/620 |

*Primary Examiner*—William Price
*Assistant Examiner*—Gary E. Elkins
*Attorney, Agent, or Firm*—Klaas & Law

[57] ABSTRACT

A carton blank formed from a paperboard sheet having a grain extending in one direction and at least one tear line in the carton blank which tear line extends in a direction across the grain.

3 Claims, 5 Drawing Figures

CARTON BLANK WITH PERFORATED TEAR LINE

FIELD OF INVENTION

This invention relates generally to carton blanks which may be folded into cartons and more particularly to a carton blank having at least one tear line so that a panel in a carton formed from the carton blank may be readily torn away to display the merchandise in the carton.

BACKGROUND OF THE INVENTION

For many years, cartons have been made with tear-away cover panels for display-of-goods purposes. Such cartons have been conventionally constructed in a manner whereby a tear line extends along the grain of the paperboard material and rectangular carton blanks have been processed with the longitudinal axis of the carton extending transversely to the path of movement of the carton blank during processing. The foregoing arrangement has been thought to be required in order to provide uniform linear tear results so that the carton retains its holding characteristics. Since cartons traditionally extend in the longitudinal direction for a much greater extent than in the transverse direction, this processing limited the number of carton blanks which could be processed at the same time. Also, this processing resulted in much scrap.

SUMMARY OF THE INVENTION

This invention provides a carton blank formed from paperboard having a grain extending substantially parallel with the longitudinal axis of the carton blank and at least one tear line extending in a transverse direction in the carton blank. The carton blank is manufactured in a process wherein the longitudinal axis of the carton blank extends parallel to the direction of movement of the paperboard during processing.

In a preferred embodiment of the invention, the perforations forming the tear line comprise a double Y shape having the legs of the double Y superposed. A linear perforation extending in alignment with the superposed legs is located between each adjacent double Y. The arms of the Y extend outwardly from the leg at an angle of about 45 degree. Tests have shown that the tear may be initiated at either side of the carton and will extend uniformly thereacross from cut to cut without any significant tearing parallel to the grain of the paperboard.

It is an object of this invention to provide a tear line for a paperboard carton wherein the tear line extends across the grain of the paperboard.

It is another object of this invention to provide a system for manufacturing paperboard carton blanks with the longitudinal axis of the carton blanks extending parallel to the direction of movement of the paperboard during processing.

Additional objects, advantages, and novel features of the invention are set forth in part in the description which follows which will be understood by those skilled in the art upon examination of the following or may be learned by practice of the invention. The objects and advantages of the invention may be realized and obtained by means of the instrumentalities and combinations particularly pointed out in the appended claims.

DETAILED DESCRIPTION OF THE INVENTION

Figure 1:
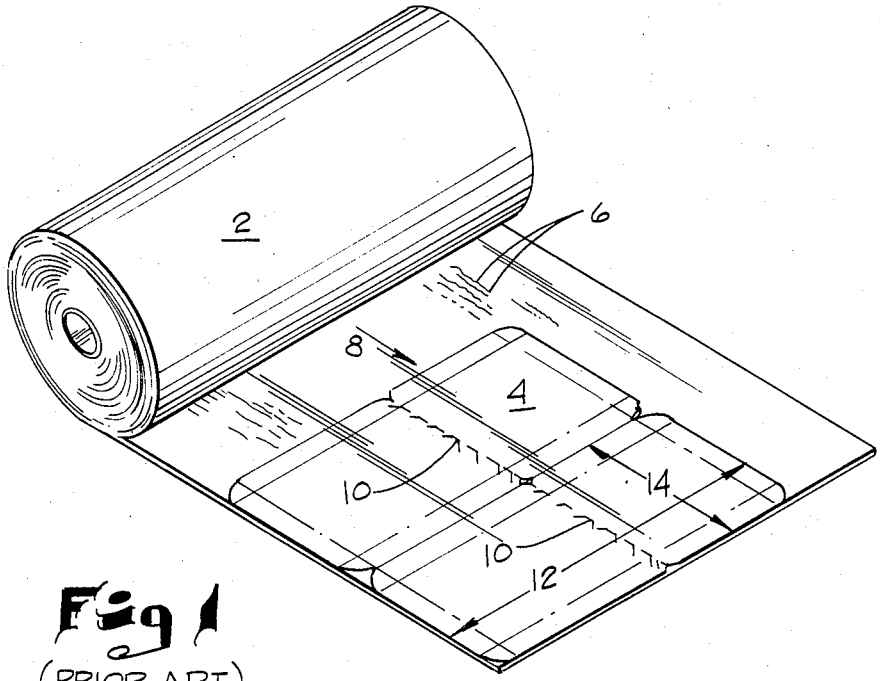
Fig 1 (PRIOR ART)
FIG. 1 is a schematic illustration of a prior art system for manufacturing paperboard carton blanks.

In FIG. 1, there is illustrated a conventional system for the manufacture of paperboard carton blanks having tear lines therein. A roll 2 of paperboard is mounted on a mechanism (not shown) whereby it may be unrolled onto a conveyor (not shown) and be processed into a carton blank 4. The conventional processes used to manufacture paperboard results in a grain 6 extending generally in the direction of the arrow 8. A conventional paperboard used in the manufacture of carton blanks will have a tear resistance of about 750 grams in the machine direction and a tear resistance of about 800 grams in the cross machine direction. This means that the paperboard will have the greater tendency to tear in the machine direction. Because of this known fact, systems for manufacturing paperboard carton blanks wherein a tear away panel for display purposes was desired would orient the carton blanks so that the tear line 10 would extend in a direction parallel to the grain 8, i.e., the machine direction. Since paperboard carton blanks extend in a longitudinal direction 12 a distance substantially greater than in the transverse direction 14, the system requires that the carton blanks be oriented with their longitudinal direction extend transversely across the machine direction during processing. This results in limiting the number of carton blanks that can be processed in a given period of time and also in substantial scrap.

Figure 2:
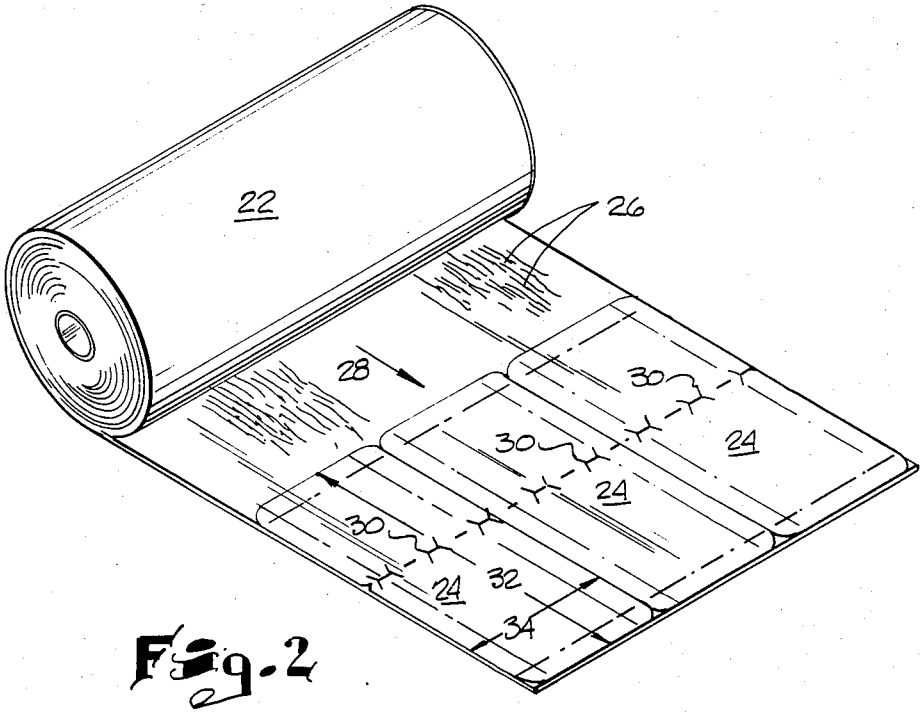
FIG. 2 is a schematic illustration of a system for manufacturing paperboard carton blanks in accordance with this invention.

In FIG. 2, there is illustrated a system in accordance with this invention for the manufacture of paperboard carton blanks having tear lines therein. A roll 22 of paperboard is mounted on a mechanism (not shown) whereby it may be unrolled onto a conveyor (not shown) and be processed into carton blanks 24. As described above, the conventional process for making paperboard results in a grain 26 extending generally in the direction of the arrow 28. In accordance with this invention, the tear line 30, described more fully below, extends across the grain 26. As a result of this, the system illustrated in FIG. 2 permits the carton blanks 24 to be oriented so that the longitudinal direction 32 of the carton blank can extend in the machine direction during processing. Also, this permits making the tear line 30 to extend in the transverse direction 34. This results in allowing more carton blanks to be processed in a given time period and in substantially reducing scrap. Each carton blank is provided with convention cut and fold lines (not shown) so that it may be readily assembled into a carton.

Figure 3:
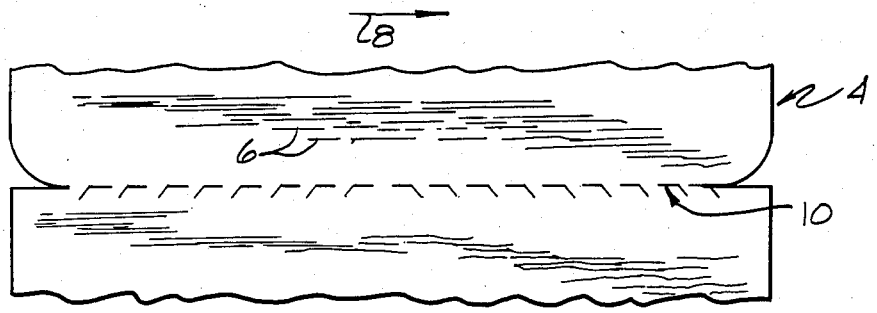
Fig. 3 (PRIOR ART)
FIG. 3 is a schematic illustration of a tear line in a prior art carton blank.

An enlarged view of a portion of a present conventional carton blank 4 having a tear line 10 is illustrated in FIG. 3. The arrow 8 indicates the direction of the grain 6. While the shape of the tear line 10 is illustrated as obtusely angled perforations, it is understood that other types of perforations have been commonly used. Since the perforations in the tear line 10 extend generally parallel to the grain 6, i.e., the machine direction for the manufacture of the paperboard, the carton blank 4 will have a natural tendency to tear in the same direction. Therefore, a uniform tear may be readily made in the carton blank 4.

Figure 4:
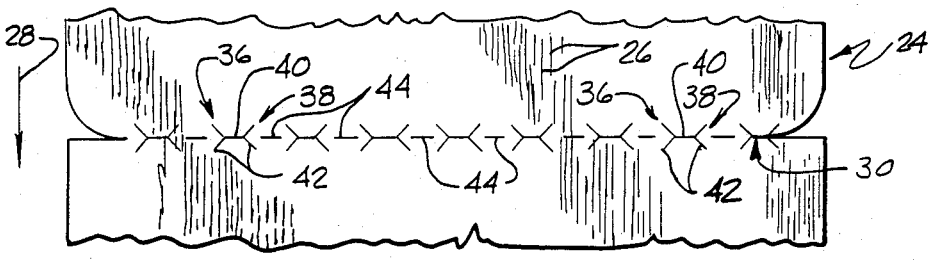
FIG. 4 is a schematic illustration of a tear line in accordance with this invention.
Figure 5:
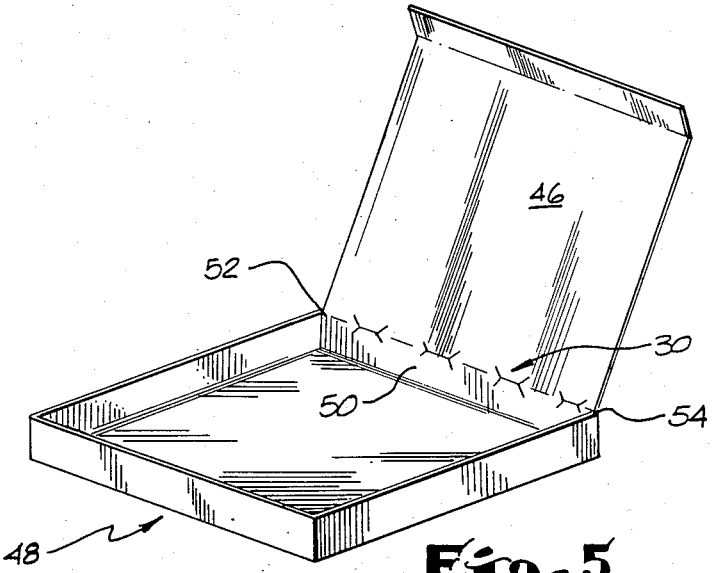
FIG. 5 is a pictorial view of a carton with the panel to be removed in an open position.

An enlarged view of a portion of a carton blank 24 made in accordance with this invention is illustrated in FIG. 4. The arrow 28 indicates the direction of the grain 26. The tear line 30 extends in a direction transverse to the direction of the grain 26. A particular type of pattern of perforations for permitting a uniform tear across the grain is illustrated in FIG. 4. Every other perforation comprises a double Y shape 36 and 38 with the legs 40 superposed. The arms 42 of the double Y shape extend outwardly from the legs 40 at an angle of about 45 degree. A linear perforation 44 is located between adjacent double Y shapes 36 and 38 with the superposed legs 4 and has a linear extent less than the superposed legs 40. The linear perforations 44 and the legs 40 of the double Y shapes 36 and 38 are in alignment. This particular configuration and pattern of the perforations in the tear line 30 permits the carton blank 24 to be separated uniformly along the tear line 30 with no tendency to tear in the direction 28 of the grain 26. Also, the carton blank 24 may be separated in either direction, such as from the right side or the left side as viewed in FIG. 4, along the tear line 30. This is particularly important in cartons formed by a carton blank and wherein it is desirous to tear a panel from the carton for display purposes. In these instances it is important that the panel tears uniformly along the tear line and does not extend into an adjacent panel. Thus, as illustrated in FIG. 5, when it is desirable to tear the panel 46 off the carton 48 along the tear line 30, it is essential that the tear does not extend into the panel 50.

In one embodiment of the invention, carton blanks 24 were made from paperboard having a thickness of about 0.028 in.; a tear resistance in the machine direction of about 750 grams and a tear resistance in the cross machine direction of about 800 grams. The double Y shape 36 and 38 were formed with the arms 42 extending outwardly at an angle of about 45 degrees. Each arm 42 had a linear extent of about 0.125 in.; each leg 40 had a linear extent of about 0.125 in. and each linear perforation 44 had a linear extent of about 0.125 in. The linear distance between the ends of the linear perforations 44 and a straight line joining the tips of the arms of each double Y shape 36 and 38 was about 0.031 in.

Cartons 48 were made from the carton blanks 24 described above and panels 46 were torn away along the tear line 30 with no extent of the tear extending into the panel 50. Tears were made starting at end 52 of the tear line 30 and at end 54 of the tear line 30.

It is contemplated that the inventive concepts herein described may be variously otherwise embodied and it is intended that the appended claims be construed to include alternative embodiments of the invention except insofar as limited by the prior art.

What is claimed is:

1. A carton blank comprising:

a paperboard sheet having a length, a width and a thickness and a grain extending in a direction along said length;

a plurality of fold lines in said paperboard sheet to define a plurality of panels which are adapted to be folded to form a carton;

at least one of said fold lines comprising a tear line;

said tear line comprising a first plurality of perforations and a second plurality of perforations formed in said paperboard sheet;

each of said first plurality of perforations comprising a double Y shape wherein each Y shape has a straight leg and two arms extending angularly from one end of said straight leg and said double Y shape is formed by superposing the leg of each Y shape with two angularly extending arms at each end of the superposed legs;

each of said second plurality of perforations comprising a linear shape; and said tear line is formed by alternating a double Y shaped perforation and a linear shaped perforation with said superposed legs and said linear shaped perforations being in alignment and forming said fold line.

2. A carton blank as in claim 1 wherein:

said tear line extends generally in a widthwise direction.

3. A carton comprising:

a plurality of panels joined together and folded around a plurality of fold lines to form a carton;

at least one of said fold lines joining one panel to another panel comprises a tear line, said tear line comprising a first plurality of perforations and a second plurality of perforations;

each of said first plurality of perforations comprising a double Y shape wherein each Y shape has a straight leg and two arms extending angularly from one end of said straight leg and said double Y shape is formed by superposing the leg of each Y shape with two angularly extending arms at each end of the superposed legs;

each of said second plurality of perforations comprising a linear shape; and said tear line is formed by alternating a double Y shaped perforation and a linear shaped perforation with said superposed legs and said linear shaped perforations being in alignment and forming said fold line.

* * * * *